US008261767B1

(12) United States Patent
Blume

(10) Patent No.: US 8,261,767 B1
(45) Date of Patent: Sep. 11, 2012

(54) POWDERED METAL INLAY

(75) Inventor: George H. Blume, Austin, TX (US)

(73) Assignee: Novatech Holdings Corp., Salt Lake City, UT (US)

( * ) Notice: Subject to any disclaimer, the term of this patent is extended or adjusted under 35 U.S.C. 154(b) by 324 days.

(21) Appl. No.: 12/763,228

(22) Filed: Apr. 20, 2010

Related U.S. Application Data

(63) Continuation-in-part of application No. 12/429,199, filed on Apr. 24, 2009, now Pat. No. 7,726,026.

(51) Int. Cl.
*F16K 51/00* (2006.01)

(52) U.S. Cl. ..... 137/375; 137/902; 251/368

(58) Field of Classification Search ..... 137/375, 137/902; 251/356, 368
See application file for complete search history.

(56) References Cited

U.S. PATENT DOCUMENTS

| | | | | |
|---|---|---|---|---|
| 1,948,628 | A | 2/1934 | Penick et al. | |
| 2,918,078 | A | 12/1959 | Cummings | |
| 3,186,430 | A | 6/1965 | Koutnik | |
| 3,510,103 | A | 5/1970 | Carsello | |
| 3,598,145 | A | 8/1971 | Wolfson | |
| 3,809,362 | A | 5/1974 | Baumann | |
| 4,373,550 | A | 2/1983 | Yelich | |
| 4,474,208 | A | 10/1984 | Looney | |
| 4,518,329 | A | 5/1985 | Weaver | |
| 4,696,321 | A | 9/1987 | Reese et al. | |
| 4,714,237 | A | 12/1987 | Linderman et al. | |
| 4,770,206 | A | 9/1988 | Sjoberg | |
| 4,915,354 | A | 4/1990 | Sims, Jr. et al. | |
| 4,951,920 | A * | 8/1990 | Tsuno | 251/368 |
| 5,060,374 | A | 10/1991 | Findlanl et al. | |
| 5,247,960 | A | 9/1993 | Kornfeldt et al. | |
| 5,375,813 | A | 12/1994 | Rozinsky | |
| 6,089,843 | A * | 7/2000 | Kondoh | 251/368 |
| 6,298,817 | B1 | 10/2001 | Hoeg | |
| 6,375,158 | B1 * | 4/2002 | Kramer et al. | 251/337 |
| 6,701,955 | B2 | 3/2004 | McIntire et al. | |
| 6,793,198 | B2 * | 9/2004 | Robison et al. | 251/357 |
| 6,886,809 | B2 * | 5/2005 | Kiyotoki et al. | 251/368 |
| 6,959,916 | B2 | 11/2005 | Chigasaki et al. | |

* cited by examiner

*Primary Examiner* — John Bastianelli
(74) *Attorney, Agent, or Firm* — Gardere Wynne Sewell LLP

(57) ABSTRACT

Differential coefficients of thermal expansion facilitate close approximation during cooling of a sintered cemented carbide tubular inlay preform (e.g., a first tubular portion) which is vacuum brazed within a corresponding tubular metal hull (e.g., a second tubular portion). Such a tubular inlay preform comprises at least one metal carbide and at least one nonvolatile cement which have previously been compressed and sintered in a predetermined shape. The tubular inlay preform's modulus of elasticity and thermal conductivity substantially exceed the corresponding parameters of the tubular metal hull, whereas the hull's coefficient of thermal expansion exceeds that of the preform. Longitudinal movement of a tubular inlay preform within a tubular hull may be limited by structural features of the hull and/or preform. Additionally, circumferential compression of a tubular inlay preform due to hoop stress in a corresponding tubular metal hull increases as the hull cools after vacuum brazing.

20 Claims, 8 Drawing Sheets

POWDERED METAL INLAY

This application is a continuation-in-part of U.S. Ser. No. 12/429,199 filed 24 Apr. 2009, which was a continuation-in-part of U.S. Ser. No. 11/382,298 filed 9 May 2006 (now U.S. Pat. No. 7,540,470).

FIELD OF THE INVENTION

The invention relates generally to high-pressure pumps used, for example, in oil and gas field operations. Components of such pumps incorporate structural features and/or fabrication techniques relating generally to inlays comprising one or more metal carbides on metal substrates.

BACKGROUND

Engineers typically design high-pressure oil field pumps in two sections; the (proximal) power section (herein "power end") and the (distal) fluid section (herein "fluid end"). The power end usually comprises a crankshaft, reduction gears, bearings, connecting rods, crossheads, crosshead extension rods, etc. In mud pumps, the power end also contains a liner within which a piston is moved in a reciprocating manner by a piston rod. Notwithstanding their location reversibly secured in the power end frame, liners (and the pistons and piston rods within them) are considered part of a pump's fluid end.

Commonly used mud pump fluid ends typically comprise a pump housing in which a suction valve and a discharge valve are associated with each liner (with its piston and piston rod) in a sub-assembly that also includes retainers, high-pressure seals, etc. A typical configuration includes three such subassemblies combined in a single pump housing. FIG. 1 shows a cross-sectional schematic view of a conventional mud pump liner having two component parts: an outer hull and an inner sleeve. See FIGS. 2A and 2B. The cylindrical inner surface of each sleeve seals against the peripheral surface of a piston seal to enable high pressure pumping.

Conventional mud pump liners were initially manufactured in a one-piece configuration from cast iron, a traditional wear-resistant bearing material. Cast iron liners were subject to corrosion and experienced rapid wear at pressures greater than about 1,000 pounds per square inch (psi), and they were replaced about 1950 by induction-hardened steel liners that had greater strength and wear-resistance, but the hardened steel had lower corrosion resistance compared to cast iron.

Chrome plating was then applied to steel liners to improve both corrosion resistance and wear resistance, and operating pressures increased to the range of 2,000 to 3,000 psi. Unfortunately the relatively thin chrome plating tended to crack at higher pressures, leading to rapid degradation and failure of the plating. Attempts to harden the underlying steel (as by carburizing) significantly raised manufacturing costs because warping induced during carburization required post-process grinding and honing that removed much of the carburized wear case.

In the 1980's, attempts were made to improve the service life of steel liners by ion nitriding the wearing surface. But the service life of such liners (typically comprising Nitriloy) was not materially improved. While the nitrided steel wear case had a hard surface (about 70 Rockwell C), it was both susceptible to corrosion and relatively thin. Early failure of the wear case exposed the softer steel underneath to rapid wear and, occasionally, catastrophic failure of the liner Such catastrophic failures are almost unknown today, thanks to the wide use of industry standard liners comprising two parts: a chrome iron sleeve shrunk fit (or otherwise interference fit) within an outer steel hull. Chrome-iron sleeve liners offer several advantages over other types of liners. First, a relatively high level of free chrome in the sleeve assures good corrosion resistance and longer life. Second, relatively high carbon and chrome levels in the sleeve allow the formation of very wear-resistant chrome carbides. And since the sleeve has the same uniform hardness throughout its cross section, wear resistance does not decrease as the sleeve wears. Thus, catastrophic wear-through failures are almost entirely avoided, but these chrome-iron sleeve liners are relatively expensive and labor intensive to manufacture.

Even more expensive, but with a 300-400% increase in wear life over hardened steel liners, are ceramic and zirconium sleeve liners. Both ceramic and zirconium sleeve liners offer excellent corrosion resistance and uniformity of wear resistance throughout liner service life, as seen in chrome-iron sleeve liners. But ceramic and zirconium sleeve liners are very brittle, requiring delicate handling on a drilling rig where the work environment is far from delicate. Additionally, ceramic and zirconium sleeves have the disadvantage of being heat insulators. That is, they tend to store the substantial frictional heat that develops primarily due to movement of the piston's elastomeric seal material on the sleeve inner wall. While metallic sleeves tend to conduct at least a portion of this frictional heat away from the piston-sleeve interface, ceramic and zirconium liners tend to store the heat instead. Stored heat results in increased piston operating temperatures that degrade piston seals, eventually allowing a piston flange to contact the liner wall and damage it. Thus, chrome-iron sleeved liners remain the most popular choice for oil and gas field operations.

The chrome-iron used in industry standard liner sleeves typically comprises 25-28% chrome, 2.5% carbon, some trace elements, with the balance being iron. In some industries this alloy is referred to as "white iron." The alloy has excellent wear and corrosion resistance, but chrome-iron sleeve liners are expensive and labor intensive to manufacture. The chrome-iron sleeve must be centrifugally cast, and because of the centrifugal force generated during casting, the favorable, heavier, alloy particles are primarily distributed closer to the outer diameter (OD) of the casting. Slag and other undesirable particles, on the other hand, are distributed on the inner diameter (ID) of the casting. Because the wear surface is on the ID, this particle arrangement after casting is just the opposite of the desired distribution. Thus the casting is made overly thick so the undesirable materials can be removed by machining that increases the ID.

But when the casting is removed from the centrifugal mold, the casting is at full hardness, approximately 60 Rockwell C, and can not be machined. Rather, the casting must first be annealed to a machinable state, which usually takes 24 hours in an annealing furnace. The casting is then rough machined, about one half the wall thickness being machined away to remove the undesirable particles from the casting ID. The casting is also cut into lengths at this time to make sleeves for the many different liner designs. Sleeves are then heat treated to regain the hardness of 60 Rockwell C, but since the sleeves warp during heat treatment, they must be returned to a near round condition.

Because of the hardness of the heat-treated (and out-of-round) sleeves, they cannot be machined. Instead, they must be ground on their OD. After grinding, the sleeve OD is measured and a steel hull is bored to an ID dimension slightly smaller than the OD of the ground sleeve. The hull is then heated to approximately 500-700° F.; at which temperature the hull ID increases so that it exceeds the OD of the ground sleeves. The ground sleeve is slipped into the ID of the hull, and as the sleeve-hull (i.e., the liner) assembly cools the hull shrinks around the sleeve to lock it in place and place the sleeve in compression via the hoop tension developed in the hull as it shrinks. After cooling, the sleeve ID is honed to bring its ID to one of several standard sizes within American Petroleum Institute (API) size tolerances. The hull OD is then machined to the final design dimensions for liners used in a particular pump.

Liners made according to the above process are much more durable than the original one-piece cast iron liners, but also much more expensive. An improved liner is needed that will substantially equal or outperform the current industry standard liner while reducing manufacturing cost.

SUMMARY OF THE INVENTION

Differential coefficients of thermal expansion facilitate close approximation during cooling of a sintered cemented carbide tubular inlay preform (e.g., a first tubular portion) which is vacuum brazed within a corresponding tubular metal hull (e.g., a second tubular portion). Such a tubular inlay preform comprises at least one metal carbide and at least one nonvolatile cement which have previously been compressed and sintered in a predetermined shape. The tubular inlay preform's modulus of elasticity and thermal conductivity substantially exceed the corresponding parameters of the tubular metal hull, whereas the hull's coefficient of thermal expansion exceeds that of the preform. Longitudinal movement of a tubular inlay preform within a tubular hull may be limited by structural features of the hull and/or preform. Examples of such structural features include an inner surface lip extending inward from the hull's inner surface, and/or one or more frusto-conical portions of the preform's outer surface, at least one such portion being paired with (i.e., closely approximating and radially opposing) a corresponding frusto-conical portion of the hull's internal surface. In each such pairing of a preform's outer surface frusto-conical portion and a corresponding frusto-conical portion of a hull's inner surface, the two frusto-conical portions closely approximate a common length and taper. Additionally, circumferential compression of a tubular inlay preform due to hoop stress in a corresponding tubular metal hull increases as the hull cools after vacuum brazing.

A first invention embodiment comprises a sintered tubular inlay preform which is substantially symmetrical about an inlay preform longitudinal axis and comprises at least one metal carbide and at least one nonvolatile cement, the inlay preform having a preform first end spaced longitudinally apart from a preform second end. The inlay preform further has a preform outer surface spaced radially apart from a preform inner surface. The preform first end extends a first radial distance between the preform outer surface and the preform inner surface, and the preform second end extends a second radial distance between the preform outer surface and the preform inner surface.

The above first embodiment sintered tubular inlay preform typically comprises about 70% to about 98% of one or more metal carbides (e.g., carbides of vanadium, molybdenum, tungsten and/or chromium), together with at least one nonvolatile cement (comprising, e.g., cobalt, chromium and/or nickel, electively in a eutectic mixture). Powdered metal carbide and cement components of a tubular metal preform may electively be formed, for example, by centrifugal casting or by being compressed in a predetermined shape (typically by cold-isostatic-pressure or CIP) and sintered. Such a sintered tubular inlay preform then comprises cemented carbide with about 1% to about 3% voids and a modulus of elasticity greater than about $30\times10^6$ psi, whereas a tubular hull (comprising, for example, steel) will have a modulus of elasticity less than that of a sintered tubular inlay preform. A tubular hull will also have a coefficient of thermal expansion exceeding than that of a sintered tubular inlay preform (which is less than about $11\times10^{-6}$/K). A tubular hull further has a thermal conductivity less than that of a sintered tubular inlay preform (which is greater than about 55 W/mK). A sintered tubular inlay preform may be in the form of an inlay sleeve which can be assembled to fit closely within a tubular hull. Sleeve and hull may then be sealingly vacuum brazed together with a filler metal (e.g., AWS BNi-5) to form a (layered) bimetallic structure, termed herein a tubular brazed assembly.

A tubular brazed assembly is thus a second invention embodiment that comprises the above first embodiment sintered tubular inlay preform sealingly vacuum brazed within a tubular hull with a filler metal, the tubular brazed assembly being substantially symmetrical about a brazed assembly longitudinal axis and the hull optionally comprising steel. The tubular brazed assembly has a brazed assembly first end spaced longitudinally apart from a brazed assembly second end. And the tubular brazed assembly further has a brazed assembly outer surface spaced radially apart from a brazed assembly inner surface a third radial distance adjacent the brazed assembly first end and a fourth radial distance adjacent the brazed assembly second end. The tubular hull has a hull modulus of elasticity less than the preform modulus of elasticity, and a hull coefficient of thermal expansion which exceeds the preform coefficient of thermal expansion. Further, the hull has a thermal conductivity less than the preform thermal conductivity, and the third radial distance exceeds the fourth radial distance.

A sintered tubular inlay preform (also termed a first tubular portion or powdered metal inlay in various embodiments) must be ground on its outer diameter (O.D.) after sintering to correct distortions due to warping that occurs during the sintering process. A corresponding tubular hull (also termed a second tubular portion or metal substrate in various embodiments) is typically machined on its inner diameter (I.D.) to achieve a close fit with a ground preform placed within the hull prior to vacuum brazing. Similarly-tapered opposing frusto-conical portions of preform and hull assist in achieving the close-fit interface (i.e., with preform and hull spaced slightly apart) desired to facilitate fusion. Such close and substantially uniform spacing is then occupied by a filler metal (typically a powdered eutectic such as AWS BNi-5) during vacuum brazing. In a brazing furnace, an interface comprising similarly-tapered frusto-conical surfaces has a self-centering function, tending to make the longitudinal axes of the preform and hull collinear. As the furnace temperature is raised under vacuum, excess molten filler metal moves toward the taper edges (i.e., toward the ends of the preform and hull) as the preform and hull are drawn gradually together (e.g., by gravity). The result is a strong brazed joint with filler metal distributed thinly and evenly around the interface.

A third invention embodiment comprises a tubular brazed assembly which itself comprises a sintered first tubular portion (e.g., a sintered tubular inlay preform or powdered metal inlay) sealingly vacuum brazed within a second tubular portion (e.g., a tubular hull or substrate). The first tubular portion has a first coefficient of thermal expansion and a first modulus of elasticity, and the second tubular portion has a second coefficient of thermal expansion and a second modulus of elasticity. The tubular brazed assembly is substantially symmetrical about a longitudinal axis and has an inner surface and an outer surface. And the tubular brazed assembly has a thermal conductivity which decreases substantially monotonically from the inner surface radially to the outer surface, while the second coefficient of thermal expansion exceeds the first coefficient of thermal expansion. The first modulus of elasticity may also exceed the second modulus of elasticity.

A fourth invention embodiment comprises a tubular brazed assembly which itself comprises a sintered first tubular portion (e.g., a sintered tubular inlay preform or powdered metal inlay) sealingly vacuum brazed within a second tubular portion (e.g., a tubular hull or substrate). The first tubular portion has a first coefficient of thermal expansion and a first thermal conductivity, and the second tubular portion has a second coefficient of thermal expansion and a second thermal conductivity. The tubular brazed assembly is substantially symmetrical about a longitudinal axis and has an inner surface and an outer surface. And the tubular brazed assembly has a modulus of elasticity which decreases substantially monotonically from the inner surface radially to the outer surface, while the second coefficient of thermal expansion exceeds the first coefficient of thermal expansion. The first thermal conductivity may also exceed the second thermal conductivity.

In making a tubular brazed assembly to be used as a mud pump liner, a tapered interface between preform and hull comprising similarly-tapered frusto-conical bonding surfaces provides additional advantages beyond the self-centering function. Because the tapered interface converts a portion of longitudinal force due to pump pressure to a force component normal to the interface, the shear component of such longitudinal force acting on the interface between preform and hull is reduced. This reduces stress on the brazed bond between preform and hull. Further, the wedging action of the similarly-tapered frusto-conical bonding surfaces under the longitudinal force tends to effectively transmit the force via the hull to one or more peripheral hull flanges where it can be absorbed without damage.

Note that in sealingly vacuum brazing a tubular inlay preform and a tubular hull as described herein, a vacuum of about 0.1 torr or better must be created in the brazing. Note also that brazing with a filler metal comprising, for example, nickel (e.g., BNi-5 or alloys associated with the registered trademarks Colmonoy and Nicrobraz) will tend to protect the sintered carbide particles from loss of carbon (decarburization), thus tending to preserve their hardness and wear-resistance. Certain of these brazing materials can be sprayed on surfaces to be brazed, thus facilitating quality control measures to ensure uniform and highly repeatable results. Note further that frusto-conical surface half-angles are conveniently represented and measured using phantom extensions of the relevant surface which intersect the relevant longitudinal axis, and/or measuring or indicating with respect to one or more phantom lines parallel to the relevant longitudinal axis.

DETAILED DESCRIPTION

Figure 1:
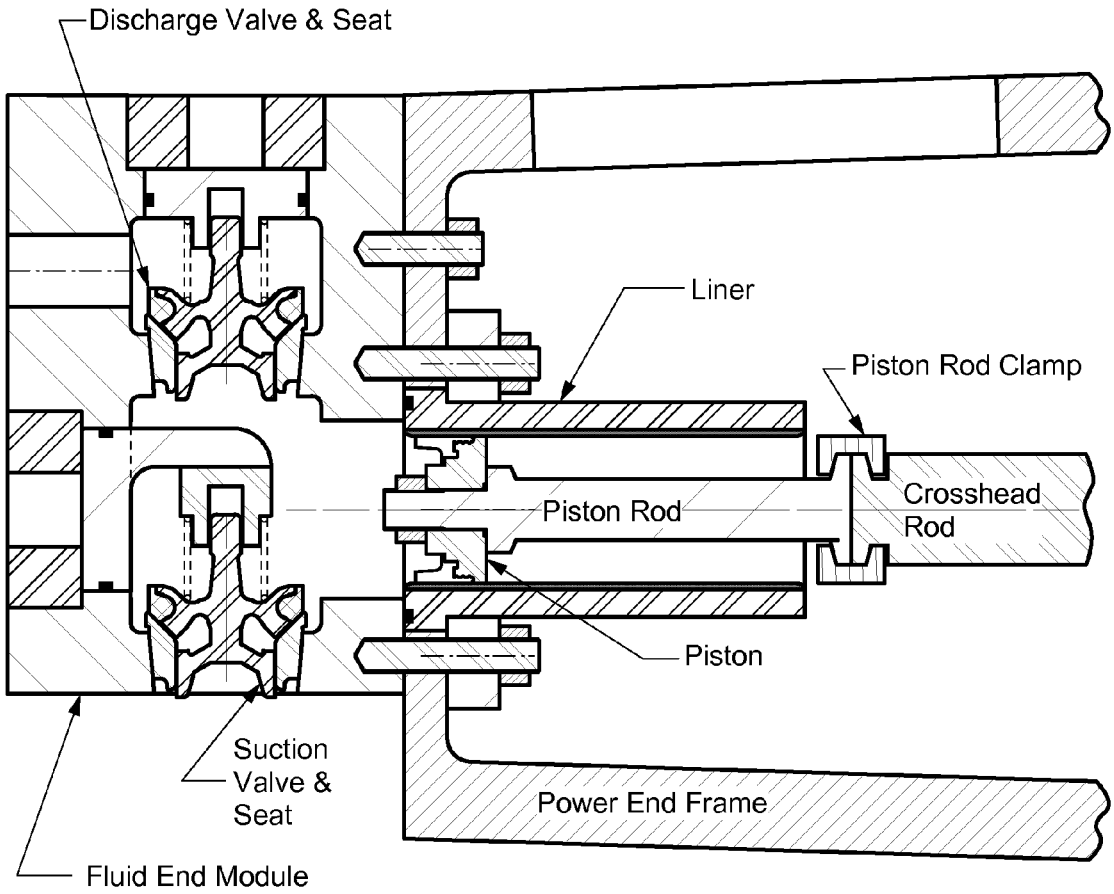
Prior Art Figure 1
FIG. 1 schematically illustrates a partial cross-section of a typical mud pump used in fracturing, showing a piston and piston rod within a conventional liner.
Figure 2A:
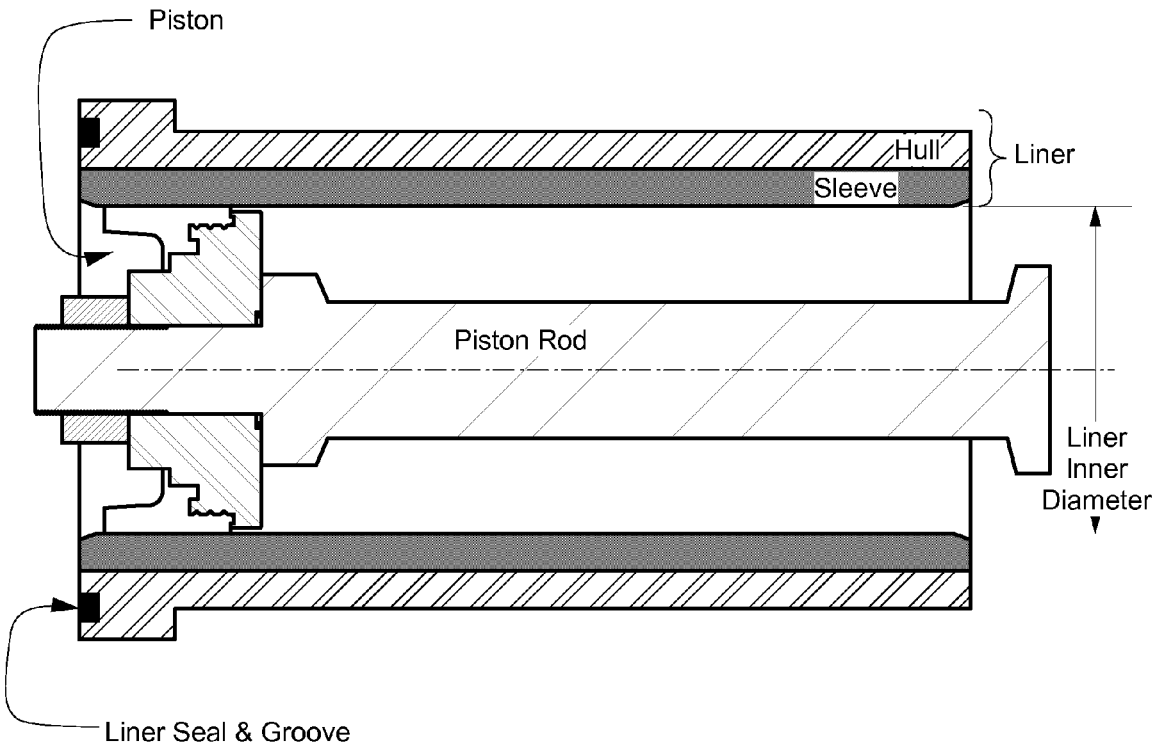
Prior Art Figure 2A
FIG. 2A schematically illustrates an enlarged view of the liner, piston and piston rod shown in FIG. 1.
Figure 2B:
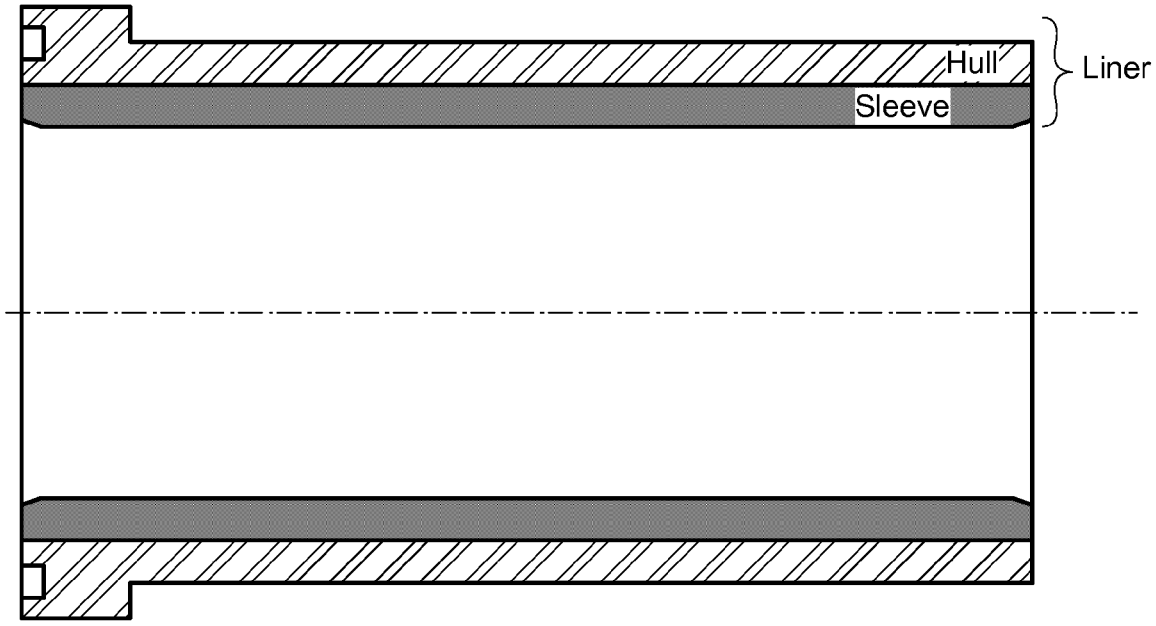
Prior Art Figure 2B
FIG. 2B schematically illustrates the enlarged view of the liner of FIG. 2A without the piston and piston rod.

The very high modulus of elasticity of cemented carbide as described herein imparts substantial strength to certain layered bimetallic structures (e.g., mud pump liners). If a cemented carbide lining or preform sleeve is fused to the inner surface of a tubular hull, as by hot isostatic pressure (HIP) or centrifugal casting, the cemented carbide is held in compression by hull hoop stress resulting from the relatively greater radial shrinkage of the hull as it cools around the cemented carbide. The high modulus of elasticity of the cemented carbide then reduces the stress on the liner hull by as much as 50% when the liner is under pressure in service.

To ensure that the desired hull stress reduction is achieved, the carbide and the hull must be fused or welded together. A bond that is less strong, such as the shrink fit of a carbide sleeve in a hull (analogous to the shrink fit of a conventional chrome-iron sleeve within a hull), will not achieve the desired hull stress reduction. Without fusion between the layers, the strength of the entire layered assembly would be reduced to the strength of each layer individually. And even though very hard materials like those found in a cemented carbide layer have very high theoretical strength, their toughness is very low. This is because very hard materials have little or no ability to yield and dissipate stress. But a fused mild steel layer (as provided by a hull in certain layered bimetallic structure embodiments described herein) has the wonderful ability to yield and thus dissipate stress which would otherwise lead to cracking of a cemented carbide layer.

There are several ways of achieving fusion or welding between adjacent layers of a layered bimetallic structure. Conventional methods include raising the local temperature sufficiently to achieve melting of the substrates of adjacent layers at the mating surfaces, as in welding. Brazing differs from welding in that fusion occurs with the cooling of a melted filler metal joining adjacent layers. Note that energy savings may be achieved in brazing a sintered tubular inlay preform within a tubular hull if, for example, the nonvolatile cement of the preform and/or the filler metal comprises one or more eutectics. In the case of a tubular hull comprising steel, for example, one or more eutectics having a melting temperature less than about 2000 degrees F. may be chosen.

Alternate methods to achieve fusion may involve heating the metals of adjacent layers to a point somewhat below the melt temperature of the respective materials and then applying external energy to force the welding of the two separate materials. Inertia welding techniques and centrifugal casting are examples of ways to apply such external energy. Hipping, as taught in the parent application, is another way to apply such external energy.

Inertia welding, centrifugal casting and hipping apply external energy in the form of kinetic energy, and as the resulting fusion occurs the kinetic energy is dissipated. In contrast, external energy may also be applied in the form of potential energy, as when one layer is shrunk around another layer. But in the latter form of bonding, the potential energy is never dissipated; it remains to hold the two layers together.

If desired reductions in hull stress are achieved through fusion of adjacent layers as described above, the inner layer (comprising, for example, a sintered tubular inlay preform) must have a relatively high modulus of elasticity relative to the hull (comprising, for example, steel). In pump liner embodiments, the rated working pressure can be significantly improved as these conditions are met. This is important as oil and gas well drilling becomes more difficult and working pressures rise. For example, the advent of directional (e.g., horizontal) drilling has required down-hole motors. These motors are powered by mud pump pressure, and the use of such motors has doubled the working pressure requirements of mud pumps. Offshore drilling also requires particularly high mud pump pressures because of the hydrostatic load on the well due to the weight of the water on top of the formation. High hydrostatic loads on the well must be balanced by heavier mud, and heavier mud creates higher frictional drag and back pressures on valves and mud pumps.

To accommodate higher working pressure requirements, mud pumps were redesigned circa 1995 to increase their rated pressure from 5500 psi to 7500 psi. But as drilling has become progressively more challenging, working pressures have continued to increase, requiring ever stronger liners. In addition, adherence to designs incorporating industry-standard liner mounting geometry has limited changes to certain liner dimensions, thus putting a premium on the desired combination of strength and rigidity found in liners analogous to the brazed tubular assemblies described herein.

Figure 3:
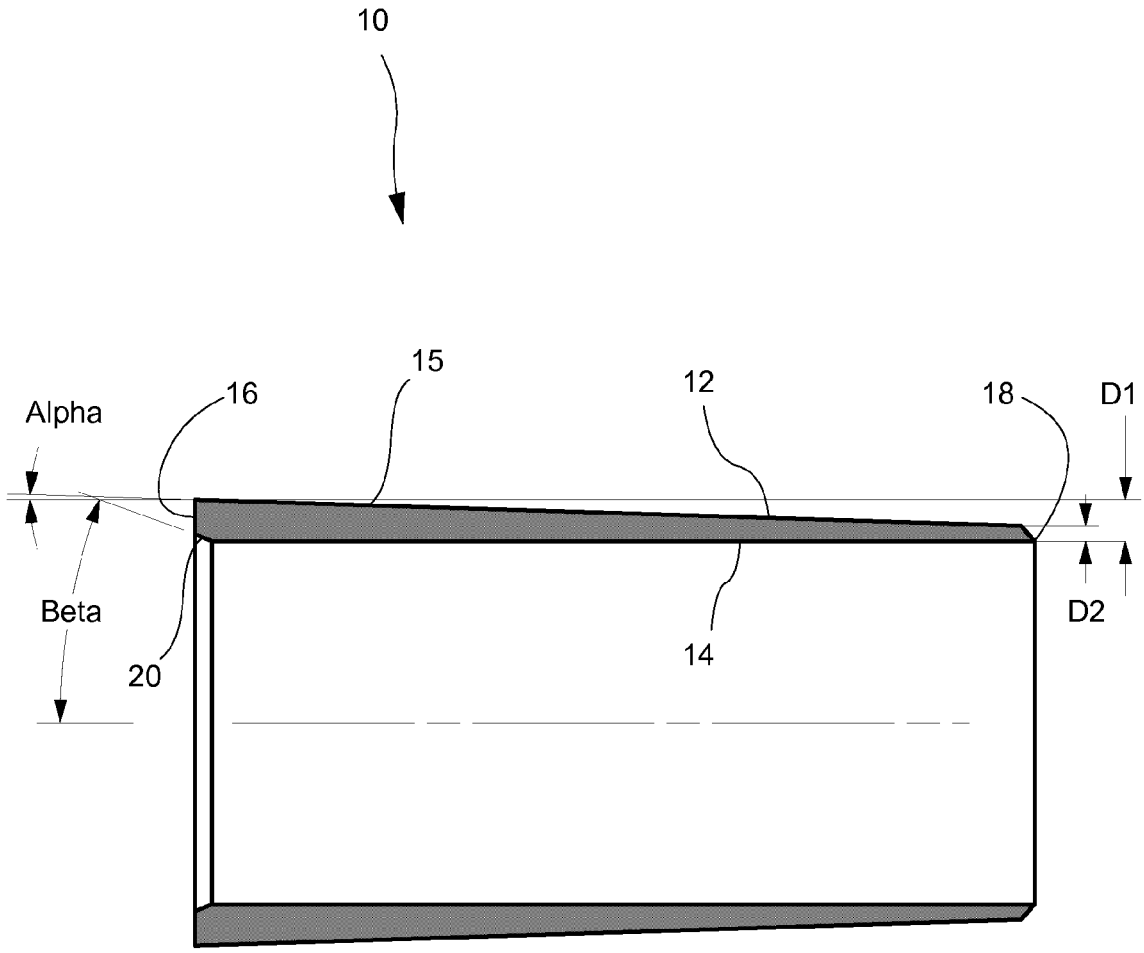
FIG. 3 schematically illustrates a cross-section of a sintered tubular inlay preform having a tapered outer surface.

FIG. 3 schematically illustrates a cross-section of a first embodiment of a sintered tubular inlay preform 10. This sintered tubular inlay preform is substantially symmetrical about an inlay preform longitudinal axis and comprises at least one metal carbide and at least one nonvolatile cement. Inlay preform 10 has a preform first end 16 spaced longitudinally apart from a preform second end 18. Inlay preform 10 further has a preform outer surface 12 and a substantially cylindrical preform inner surface 14. A tapered portion 15 of preform outer surface 12 is spaced radially apart from substantially cylindrical preform inner surface 14. A first radial distance D1 extends between the maximum diameter of tapered portion 15 and the diameter of substantially cylindrical preform inner surface 14, while a second radial distance D2 extends between the minimum diameter of tapered portion 15 and the diameter of substantially cylindrical preform inner surface 14.

A first frusto-conical portion 15 of preform outer surface 12 provides the taper schematically illustrated in FIG. 3. The degree of inlay outer surface taper is indicated by an inlay outer surface half-angle (i.e., a first half-angle) alpha with the inlay preform longitudinal axis. The inlay outer surface half-angle alpha is accurately ground after sintering to obtain an initial predetermined shape for each configuration of sintered tubular inlay preform 10. A tubular hull (see, e.g., FIG. 4) within which inlay preform 10 may be vacuum brazed may have a hull inner surface corresponding frusto-conical portion 15', first frusto-conical portion 15 radially opposing the corresponding frusto-conical portion 15'. In such an embodiment first frusto-conical portion 15 closely approximates the corresponding frusto-conical portion 15' in length and taper, the taper ranging from zero degrees to about 5 degrees. Further, sintered tubular inlay preform 10 comprises at least one metal carbide and at least one nonvolatile cement, and first radial distance D1 equals or exceeds second radial distance D2 (i.e., D1 is no less than D2).

Note that a zero degree taper may also be employed for embodiments fabricated without a using a sintered tubular inlay preform (for example, embodiments employing centrifugal casting to form an inner layer).

Preform first end 16 comprises a second frusto-conical portion 20 having an inlay first end inner surface half-angle (i.e., a second half-angle) beta with the longitudinal axis, first end inner surface half-angle beta exceeding outer surface half-angle alpha. Sintered tubular inlay preform 10 has a preform modulus of elasticity, a preform thermal conductivity, and a preform coefficient of thermal expansion as described herein.

Sintered tubular inlay preform 10 (or any alternate configuration thereof) comprises between about 1% and about 3% voids, and further comprises between about 70% and about 98% metal carbide. Further, sintered tubular inlay preform 10 (or any alternate configuration thereof) has a preform modulus of elasticity and a preform thermal conductivity which are each substantially greater than the same respective parameters of a corresponding a tubular hull such as 50 or 50' (see FIGS. 6 and 7 respectively) within which it will be sealingly vacuum brazed. On the other hand, tubular hulls such as 50 and 50' each have a hull coefficient of thermal expansion exceeding the preform coefficient of thermal expansion of a sintered tubular inlay preform that may be vacuum sintered within them. Note that tubular hulls 50 and 50' differ from each other in that tubular hull 50 has an inner surface lip whereas tubular hull 50' does not.

Figure 4:
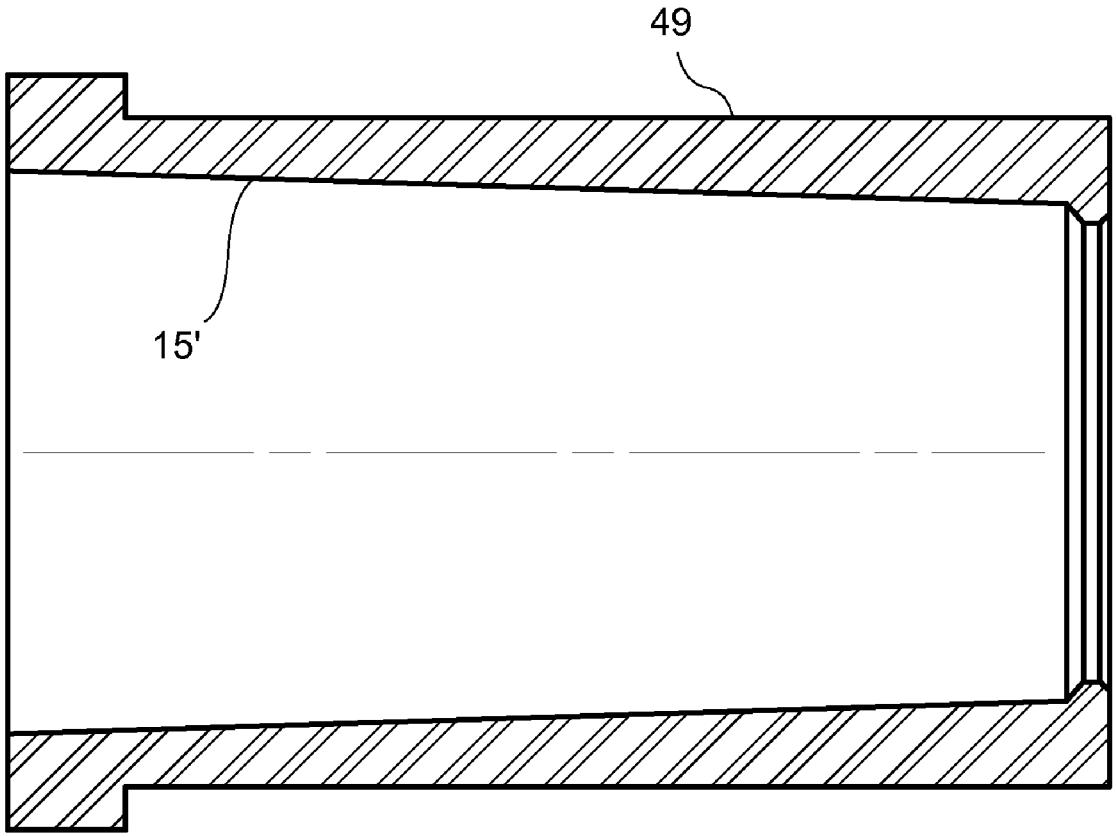
FIG. 4 schematically illustrates a cross-section of an unfinished tubular hull having first and second ends, a tapered inner surface, and an inner surface lip adjacent the second end.
Figure 5:
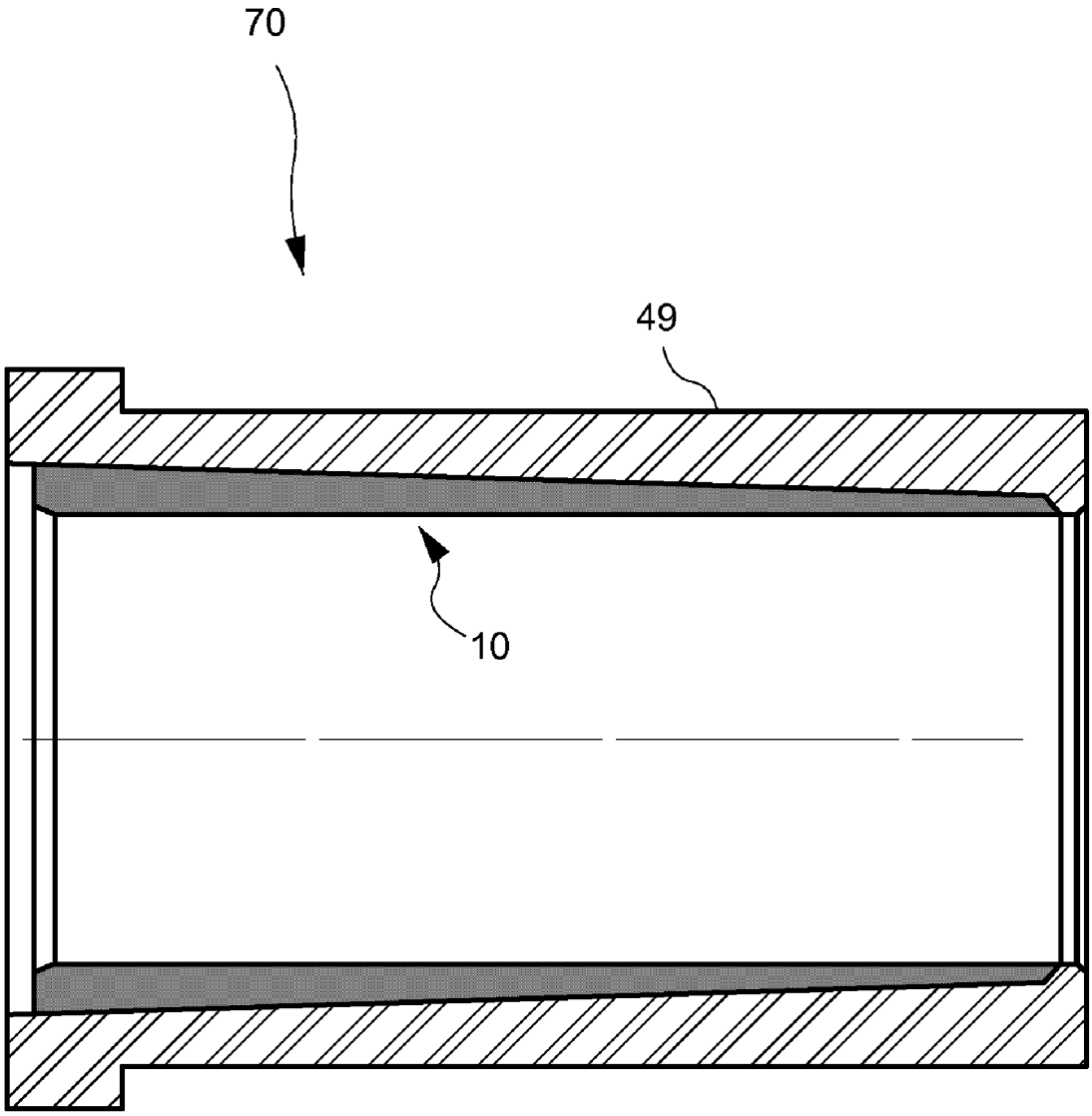
FIG. 5 schematically illustrates a cross-sectional view of an unfinished brazed assembly comprising the sintered tubular inlay preform of FIG. 3 within the unfinished tubular hull of FIG. 4.
Figure 6:
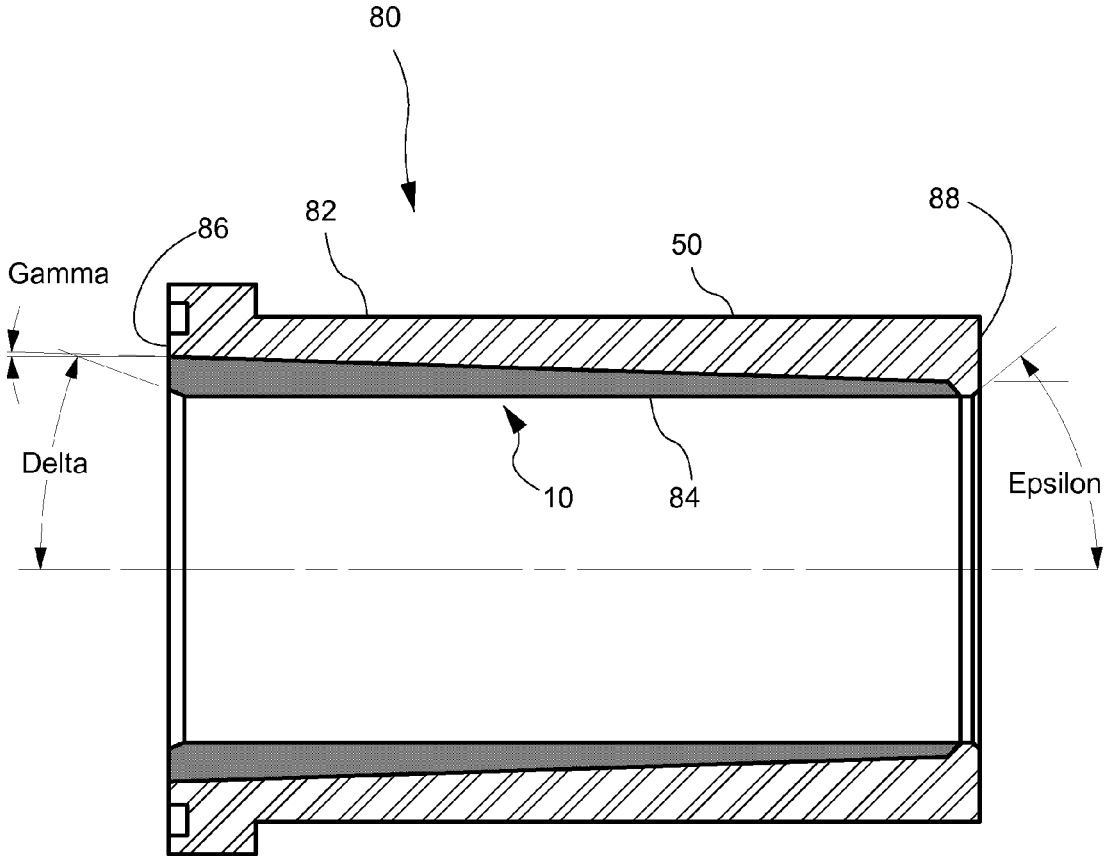
FIG. 6 schematically illustrates the cross-sectional view of the brazed assembly of FIG. 5 after finish machining, the tubular hull comprising an inner surface lip in contact with the sintered tubular inlay preform of FIG. 3.
Figure 7:
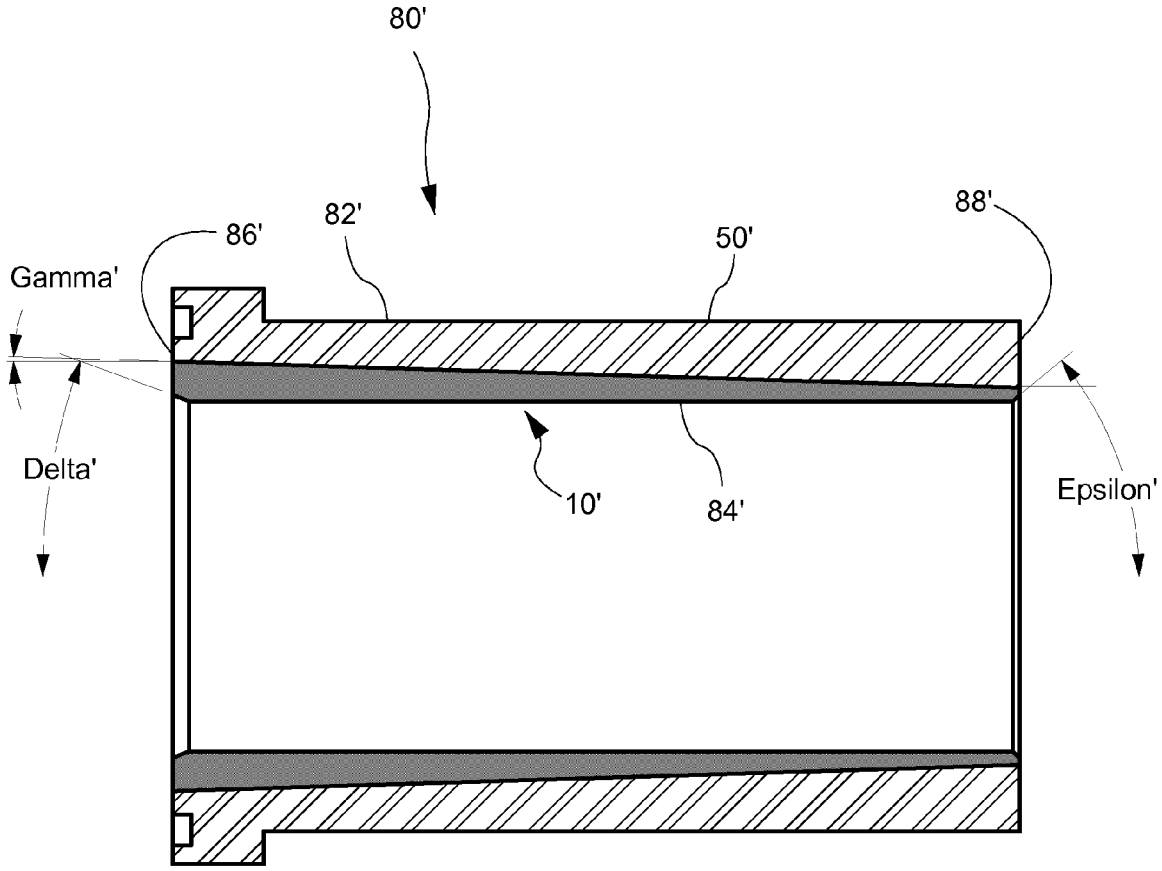
FIG. 7 schematically illustrates an alternate embodiment of a brazed assembly analogous-in-part to the brazed assembly of FIG. 6 but without the inner surface lip.

FIG. 4 schematically illustrates a cross-section of an unfinished tubular hull 49, and FIG. 5 schematically illustrates a cross-sectional view of an unfinished assembly 70 comprising sintered tubular inlay preform 10 within the unfinished tubular hull 49 of FIG. 4. FIGS. 6 and 7 schematically illustrate cross-sectional views of first and second alternative embodiments of finish machined tubular brazed assemblies 80 and 80' respectively, tubular brazed assemblies 80 and 80' comprising sintered tubular inlay preforms 10 and 10' vacuum brazed within the tubular hulls 50 and 50' respectively.

Tubular brazed assemblies 80 and 80' are each substantially symmetrical about a tubular brazed assembly longitudinal axis. Tubular brazed assemblies 80 and 80' have tubular brazed assembly first ends 86 and 86' respectively spaced longitudinally apart from tubular brazed assembly second ends 88 and 88' respectively. Tubular brazed assemblies 80 and 80' further have tubular brazed assembly outer surfaces 82 and 82' respectively spaced radially apart from tubular brazed assembly inner surfaces 84 and 84' respectively.

Tubular hulls 50 and 50' (or any alternate configuration thereof) each have a hull modulus of elasticity and a hull thermal conductivity which are less than the same respective parameters of tubular inlay preforms 10 and 10'. On the other hand, tubular hulls 50 and 50' each have a hull coefficient of thermal expansion exceeding the preform coefficient of thermal expansion of tubular inlay preforms 10 and 10' respectively.

The inlay outer surface half-angle alpha (see FIG. 3) substantially equals the hull inner surface half-angles gamma and gamma' (see FIGS. 6 and 7 respectively), and first end half-angle beta (see FIG. 3) substantially equals first end half-angles delta and delta' (see FIGS. 6 and 7 respectively). These angles are not substantially altered by exposure to vacuum brazing. Note that tubular brazed assemblies 80 and 80' are each finish machined with second end half-angles epsilon and epsilon' (see FIGS. 6 and 7 respectively) to facilitate insertion of a piston.

What is claimed is:

1. A sintered tubular inlay preform substantially symmetrical about an inlay preform longitudinal axis and comprising at least one metal carbide and at least one nonvolatile cement, said inlay preform having a preform first end spaced longitudinally apart from a preform second end, and said inlay preform further having a preform outer surface spaced radially apart from a preform inner surface, said preform first end extending a first radial distance between said preform outer surface and said preform inner surface, and said preform second end extending a second radial distance between said preform outer surface and said preform inner surface;

wherein said inlay preform comprises between about 1% and about 3% voids;

wherein said inlay preform comprises between about 70% and about 98% metal carbide;

wherein said inlay preform has a preform modulus of elasticity greater than about $30\times10^6$ psi;

wherein said inlay preform has a preform coefficient of thermal expansion less than about $11\times10^{-6}$/K; and wherein said inlay preform has a preform thermal conductivity greater than about 55 W/mK.

2. The inlay preform of claim 1 wherein at least one said nonvolatile cement comprises cobalt.

3. The inlay preform of claim 1 wherein at least one said metal carbide comprises tungsten.

4. The inlay preform of claim 1 wherein said preform outer surface comprises at least a first frusto-conical portion, said first frusto-conical portion having a first half-angle with said inlay preform longitudinal axis.

5. The inlay preform of claim 4 wherein said preform inner surface comprises a second frusto-conical portion adjacent said preform first end, said second frusto-conical portion having a second half-angle with said inlay preform longitudinal axis, said second half-angle exceeding said first half-angle.

6. The inlay preform of claim 1 wherein said first radial distance is no less than said second radial distance.

7. The inlay preform of claim 1 wherein at least one said nonvolatile cement comprises a eutectic.

8. The inlay preform of claim 7 wherein at least one said eutectic has a melting temperature less than about 2000 degrees F.

9. A tubular brazed assembly comprising the sintered tubular inlay preform of claim 1 sealingly vacuum brazed within a tubular hull with a filler metal, said tubular brazed assembly being substantially symmetrical about a brazed assembly longitudinal axis, said tubular brazed assembly having a brazed assembly first end spaced longitudinally apart from a brazed assembly second end, and said tubular brazed assembly further having a brazed assembly outer surface spaced radially apart from a brazed assembly inner surface a third radial distance adjacent to said brazed assembly first end and a fourth radial distance adjacent said brazed assembly second end;

wherein said tubular hull has a hull modulus of elasticity less than said preform modulus of elasticity;

wherein said tubular hull has a hull coefficient of thermal expansion exceeding said preform coefficient of thermal expansion; and wherein said tubular hull has a hull thermal conductivity less than said preform thermal conductivity.

10. The brazed assembly of claim 9 wherein said filler metal comprises AWS BNi-5.

11. The brazed assembly of claim 9 wherein said tubular hull comprises steel.

12. The brazed assembly of claim 9 wherein said tubular hull comprises an inner surface lip.

13. The brazed assembly of claim 12 wherein said tubular inlay preform contacts said inner surface lip.

14. The brazed assembly of claim 9 wherein said first radial distance is no less than said second radial distance.

15. The brazed assembly of claim 9 wherein said preform outer surface comprises a first frusto-conical portion and said tubular hull comprises a hull inner surface which itself comprises a corresponding frusto-conical portion, said first frusto-conical portion radially opposing said corresponding frusto-conical portion, and said first frusto-conical portion closely approximating said corresponding frusto-conical portion in length and taper.

16. The brazed assembly of claim 15 wherein said preform inner surface comprises a second frusto-conical portion adjacent said preform first end and a third frusto-conical portion adjacent said preform second end.

17. A tubular brazed assembly comprising a sintered first tubular portion sealingly vacuum brazed within a second tubular portion, said first tubular portion having a first coefficient of thermal expansion and a first modulus of elasticity, and said second tubular portion having a second coefficient of thermal expansion and a second modulus of elasticity, said tubular brazed assembly being substantially symmetrical about a longitudinal axis and having an inner surface and an outer surface, wherein said tubular brazed assembly has a thermal conductivity which decreases substantially monotonically from said inner surface radially to said outer surface, and wherein said second coefficient of thermal expansion exceeds said first coefficient of thermal expansion.

18. The brazed assembly of claim 17 wherein said first modulus of elasticity exceeds said second modulus of elasticity.

19. A tubular brazed assembly comprising a sintered first tubular portion sealingly vacuum brazed within a second tubular portion, said first tubular portion having a first coefficient of thermal expansion and a first thermal conductivity, and said second tubular portion having a second coefficient of thermal expansion and a second thermal conductivity, said tubular brazed assembly being substantially symmetrical about a longitudinal axis and having an inner surface and an outer surface, wherein said tubular brazed assembly has a modulus of elasticity which decreases substantially monotonically from said inner surface radially to said outer surface, and wherein said second coefficient of thermal expansion exceeds said first coefficient of thermal expansion.

20. The tubular brazed assembly of claim 19 wherein said first thermal conductivity exceeds said second thermal conductivity.

* * * * *